US006579128B1

(12) United States Patent
Wu

(10) Patent No.: US 6,579,128 B1
(45) Date of Patent: Jun. 17, 2003

(54) CABLE CONNECTOR ASSEMBLY WITH RELIABLY TERMINATED WIRES

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/210,380

(22) Filed: Jul. 31, 2002

(51) Int. Cl.[7] ..... H01R 24/00
(52) U.S. Cl. ..... 439/676
(58) Field of Search ..... 439/676–680, 439/681, 374, 620, 701

(56) References Cited

U.S. PATENT DOCUMENTS 6,257,935 B1 7/2001 Zhang et al.
6,368,160 B2 4/2002 Chang
6,375,514 B1 * 4/2002 Chih et al. ..... 439/676
6,402,563 B1 6/2002 Shi et al.
6,416,364 B1 7/2002 Shi et al.
6,461,200 B1 * 10/2002 Shi et al. ..... 439/676

* cited by examiner

*Primary Examiner*—Lynn D. Feild
*Assistant Examiner*—Son V. Nguyen
(74) *Attorney, Agent, or Firm*—Wei Te Chung

(57) ABSTRACT

A cable connector assembly (1) includes an electrical connector and a cable having a plurality of wires (5). The electrical connector includes a dielectric housing (2) defining a receiving space (21) at the front thereof and a receiving opening (26) at the rear thereof. A plurality of terminals (32) is securely received in the housing, and each includes a contact portion (32*a*) extending into the receiving space, a retaining portion (32*b*) and a tail portion (32*c*). A wire spacer (4) is inserted into the receiving opening of the housing. The wire spacer includes a body (41) defining a plurality of grooves (42) for receiving the conductors (51) of wires (5) therein which contact the tail portions of the terminals. A window (44) is defined in the body corresponding to the tail portions of the terminals received in the housing. A termination tool can insert through the window to form solder connection between the conductors of the wires and the tail portions of the terminals.

1 Claim, 12 Drawing Sheets

CABLE CONNECTOR ASSEMBLY WITH RELIABLY TERMINATED WIRES

BACKGROUND OF THE INVENTION

1. Field of the Invention

The present invention generally relates to a cable connector assembly used in wire telephone networks, and more particularly to a low profile cable connector assembly, which can readily and securely terminate wires of a cable.

2. Description of Related Art

A cable connector assembly needs to terminate wires of a cable. Connection of wires of a cable with terminals of a connector can be attained in several ways, such as by applying the insulation displacement connection (IDC) technology, or by using a printed circuit board which interconnects the cable and the connector. U.S. Pat. No. 6,402,563, which has the same assignee as the present invention, discloses an RJ-45 cable connector assembly. The assembly includes a wire-securing element having a base, a plurality of vertical receiving grooves and a plurality of vertical through holes. The receiving grooves are defined in a front portion of the base for receiving engaging portions of contacts of the assembly. The through holes are defined in a rear portion of the base and in communication with the receiving grooves. Wires of a cable are pressed and embedded in the receiving grooves of the wire-securing element by the engaging portions of the contacts. However, the electrical connection between the engaging portions of the contacts and the wires is less reliable and durable. When an electronic device, in which the cable connector assembly is mounted, is moved to different spots, the cable is inevitably pulled or dragged to some extent. Thus, the electrical connection will not be reliable and the signal transmission therebetween will be adversely affected.

U.S. patent application Ser. No. 10/005,735, which has the same assignee as the present invention, discloses a cable connector assembly having another connection type between terminals and wires. The cable connector assembly includes a housing defining a receiving space for receiving a complementary connector, and a terminal module for being assembled in the housing. The terminal module comprises a horizontal portion and a vertical portion. Each terminal comprises a mounting portion insert molded in the horizontal portion, a tail portion extending upwardly from a rear end of the mounting portion for connecting with a corresponding conductor of a wire, and an inclined contacting portion extending upwardly from a front end of the mounting portion. The tail portions of the terminals are first soldered to the conductors of the cable at upper ends thereof, and then insert molded in the vertical portion of the terminal module together. The connection between the terminals and the conductors is reliable enough. However, to ensure a reliable connection between the terminals and the conductors, the terminals must be accurately aligned with the conductors at the upper ends thereof, which complicates assembly. Furthermore, since the conductors of the cable protrude through the top of the vertical portion of the base, the overall height of the cable connector assembly is thus increased. Therefore, there still remains room for decrease in the height of such a cable connector assembly.

Hence, it is desired to have an improved cable connector assembly that addresses the problems encountered in the related art.

SUMMARY OF THE INVENTION

Accordingly, an object of the present invention is to provide a cable connector assembly which terminates wires reliably and durably.

An other object of the present invention is to provide a lower profile cable connector assembly.

To achieve the above objects, a cable connector assembly in accordance with the present invention comprises an electrical connector and a cable having a plurality of wires. The electrical connector comprises a dielectric housing, a plurality of terminals and a wire spacer. The dielectric housing defines a receiving space at the front thereof, and a receiving opening at the rear thereof. The terminals are securely received in the dielectric housing. Each terminal includes a contact portion extending into the receiving space, a retaining portion and a tail portion. The wire spacer is inserted into the receiving opening of the housing. The wire spacer includes a body defining a plurality of grooves for receiving conductors of the wires therein which contact the tail portions of the terminals. A window is defined in the body corresponding to the tail portions of the terminals received in the housing. A termination tool can insert through the window to form solder connection between the conductors of the wires and the tail portions of the terminals.

Other objects, advantages and novel features of the invention will become more apparent from the following detailed description when taken in conjunction with the accompanying drawings.

DETAILED DESCRIPTION OF THE INVENTION

Figure 1:
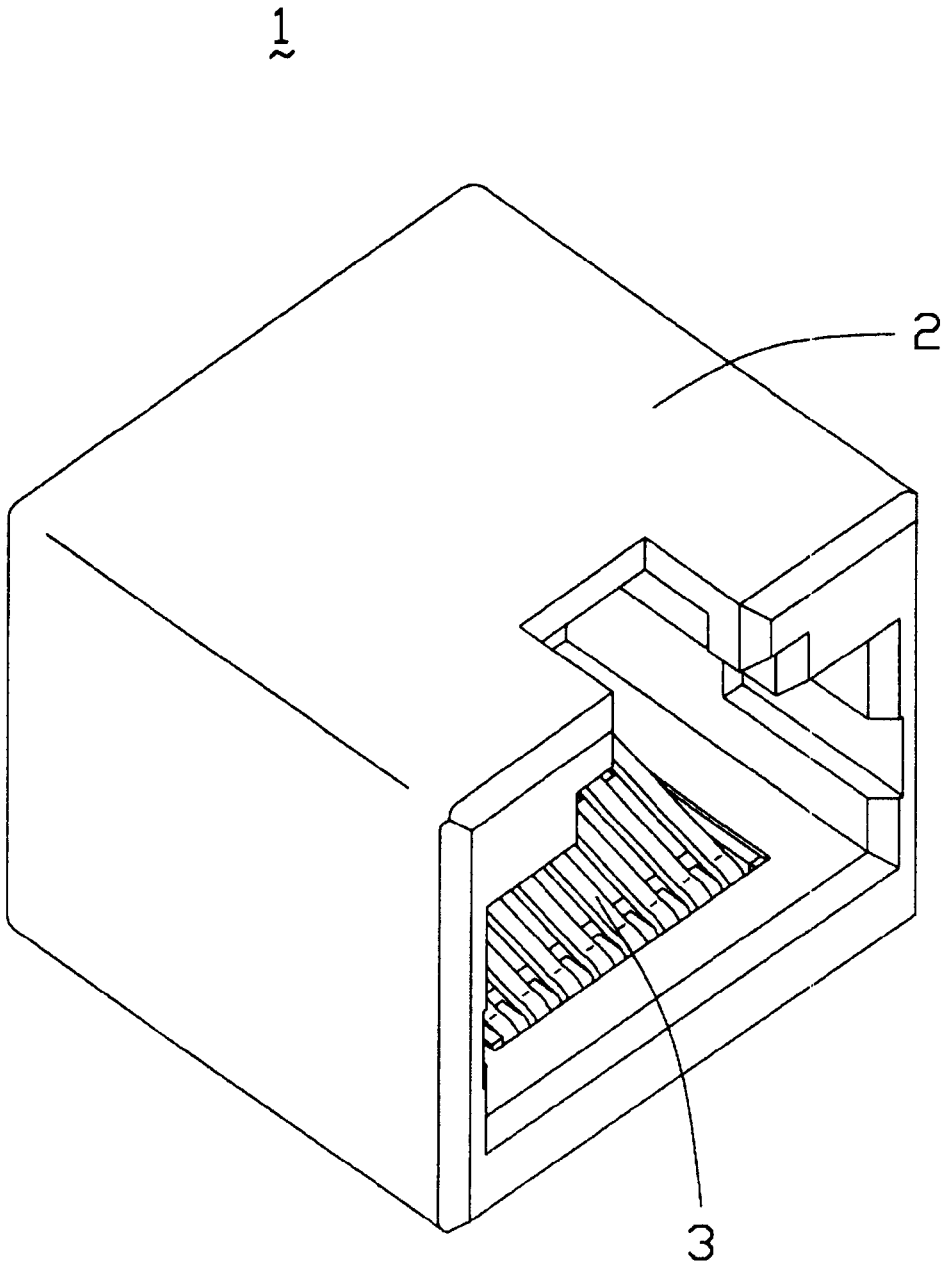
FIG. 1 is an assembled view of a cable connector assembly in accordance with the present invention.
Figure 2:
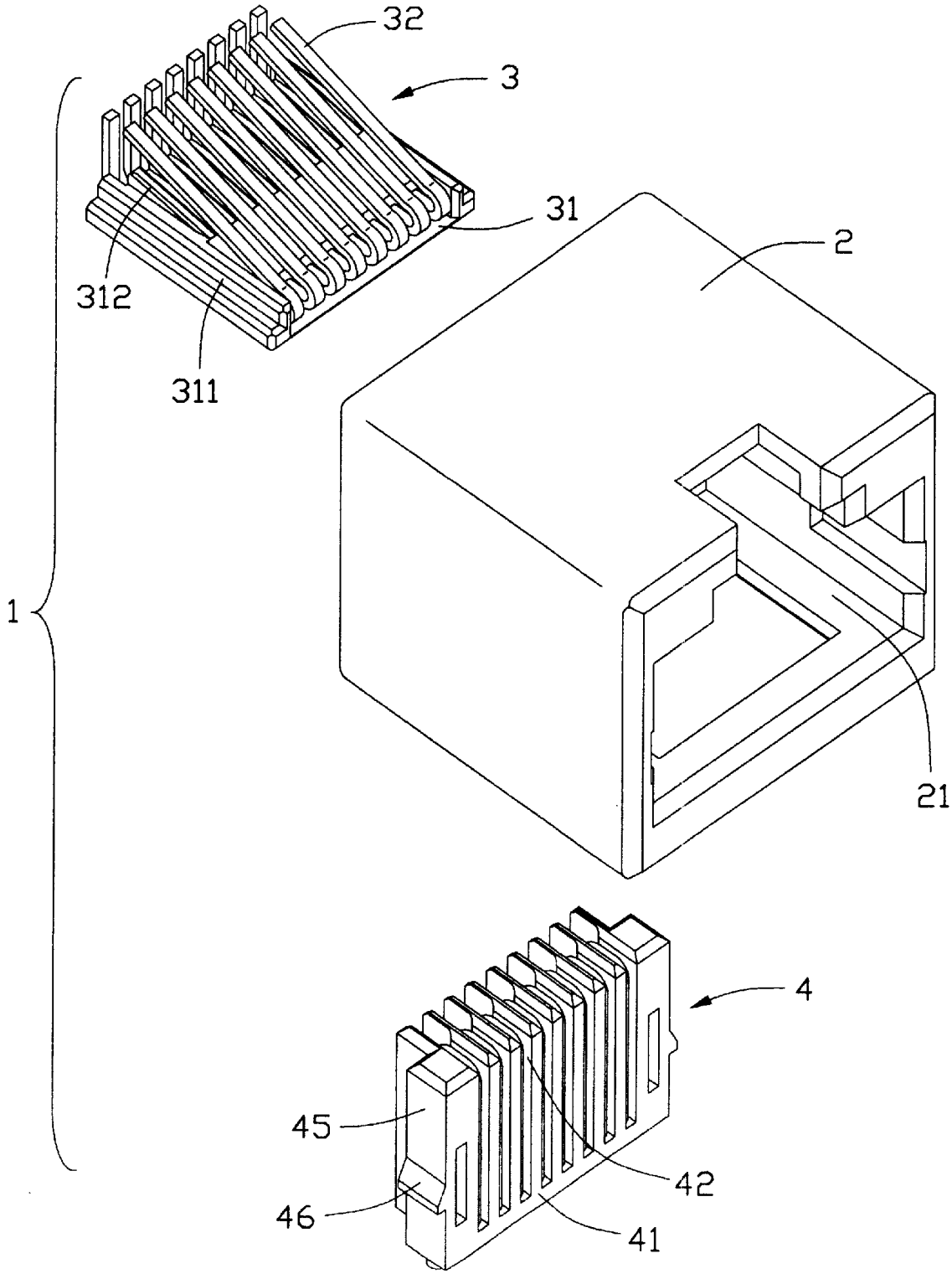
FIG. 2 is an exploded, perspective view of FIG. 1.
Figure 3:
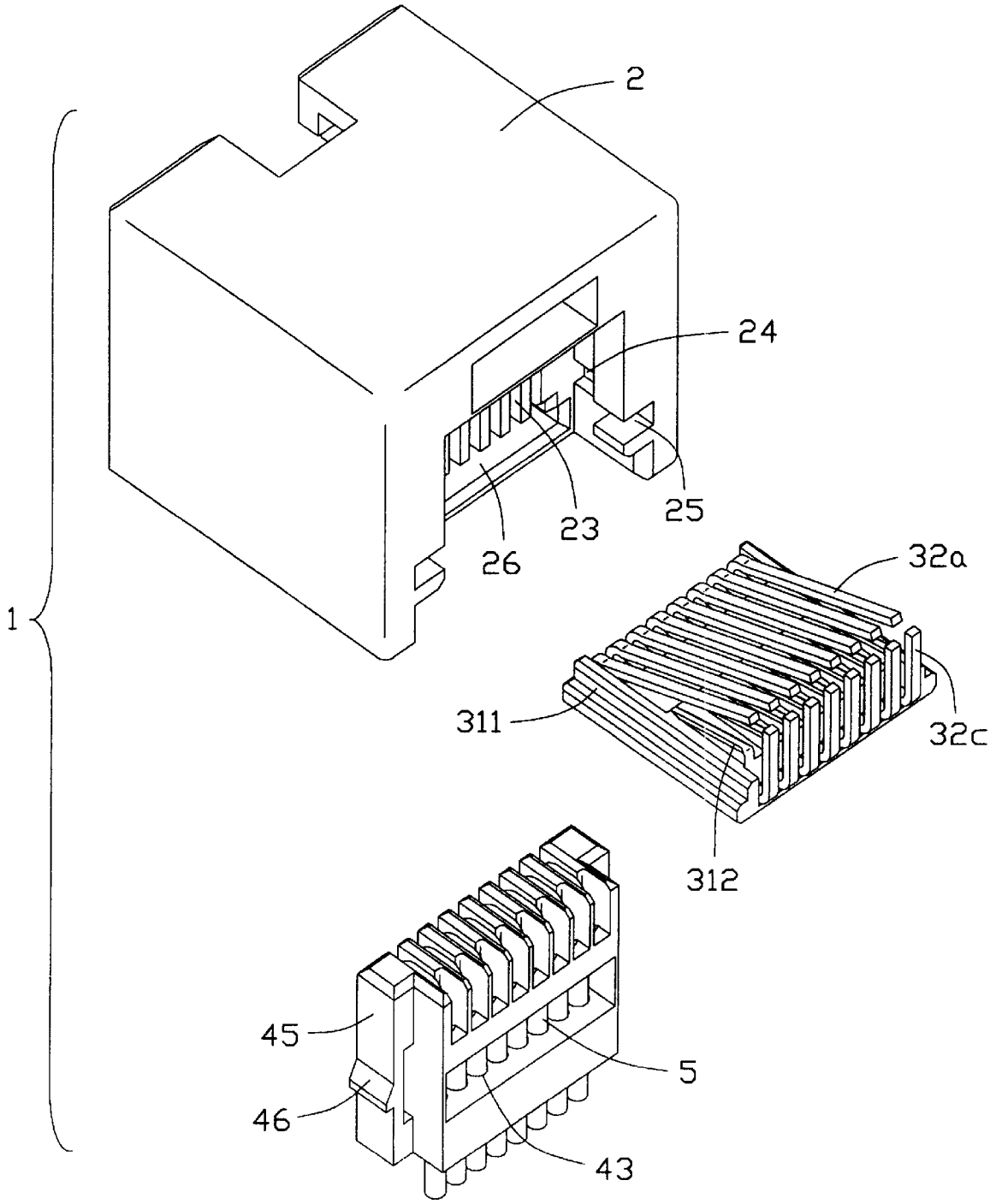
FIG. 3 is an exploded, perspective view of the cable connector assembly from a rear aspect.
Figure 4:
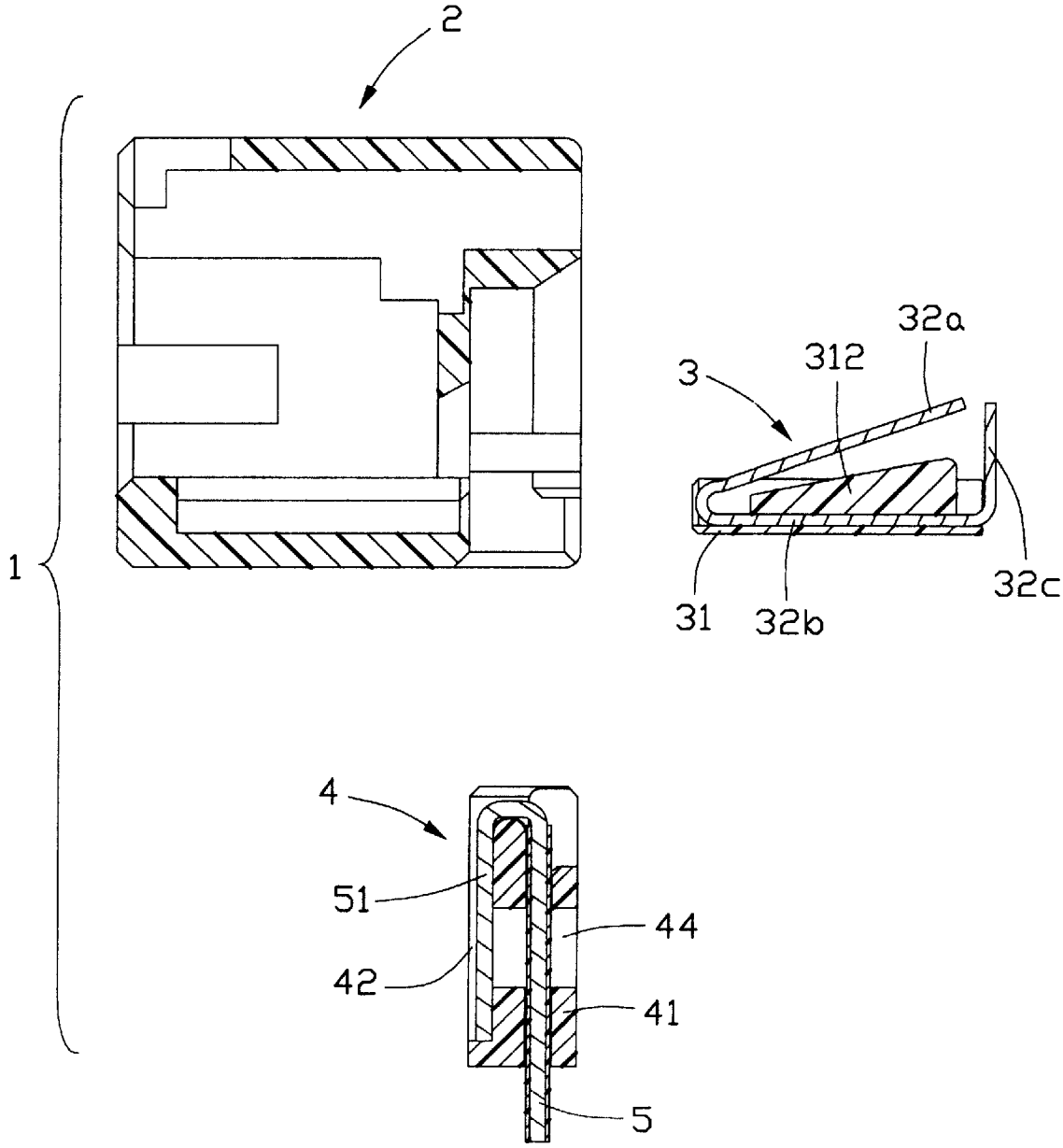
FIG. 4 is a cross sectional view of FIG. 3.

Referring to FIGS. 1–4, a cable connector assembly 1 in accordance with the present invention comprises an electrical connector and a cable having a plurality of wires 5. The electrical connector comprises a dielectric housing 2, a terminal module 3, and a wire spacer 4. In the preferred embodiment of the present invention, the electrical connector is in the form of a modular jack.

The dielectric housing 2 defines a receiving space 21 for receiving the terminal module 3 therein. The dielectric housing 2 further defines a plurality of slots 23 communicating with the receiving space 21 in a rear portion of the housing 2. A receiving opening 26 is defined in the rear of and in communication with the slots 23 for accommodating the wire spacer 4. A pair of rectangular recesses 24 is defined in opposite inner side walls of the housing 2 and in communication with the receiving opening 26. A pair of rectangular cutouts 25 is defined in the rear of the housing 2 and in communication with corresponding recesses 24 for guiding the wire spacer 4 into the receiving opening 26.

The terminal module 3 comprises a base 31, and a plurality of terminals 32 insert molded with the base 31. The base 31 is made of an insulative material such as plastic, and has a plurality of stoppers 312 corresponding to the terminals 32. Each stopper 312 extends upwardly and rearwardly from a middle portion of the base 31. The base 31 forms a pair of step-like side portions 311 on opposite sides thereof. Each terminal 32 includes a contact portion 32*a*, a retaining portion 32*b* insert molded in the base 31 and a tail portion 32*c*. The contact portion 32*a* extends upwardly and rearwardly from a front end of the retaining portion 32*b* at an acute angle. The tail portion 32*c* extends vertically and upwardly from a rear end of the retaining portion 32*b*. The contact portion 32*a* and the tail portion 32*c* are adapted for mating with a corresponding terminal of a modular plug (not shown) and for soldering to a corresponding wire 5 received in the wire spacer 4, respectively.

The wire spacer 4 has a body 41, a plurality of substantially L-shaped vertical receiving grooves 42 and a plurality of vertical through holes 43. The L-shaped receiving grooves 42 are defined in front and upper surfaces of the body 41. The through holes 43 are vertically defined through the body 41 intersecting a window 44 and communicating with the receiving grooves 42. The window 44 is rectangular and defined horizontally in a middle portion of the body 41 and extends from a rear surface of the body 41 to the receiving grooves 42 defined in the front portion of the body 41. A pair of projections 45 is integrally formed on opposite ends of the body 41. Each projection 45 has a latch 46 in a middle portion thereof for engaging a corresponding recess 24 of the housing 2. Each wire 5 has an internal conductor 51.

Figure 5:
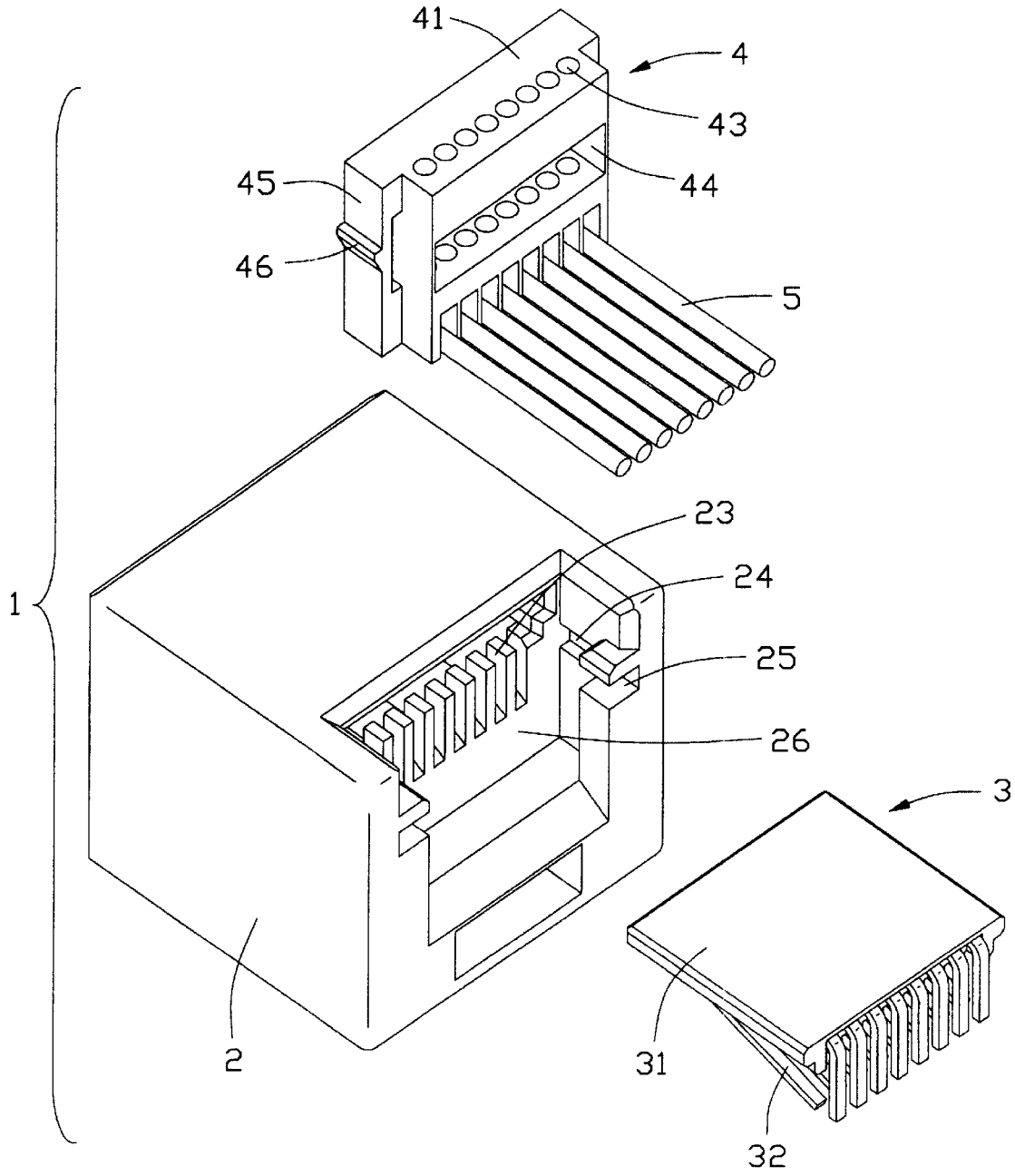
FIG. 5 is an exploded, perspective view of the cable connector assembly from bottom and rear aspects.

In assembly, referring to FIG. 5, the conductors 51 of the wires 5 are first pre-assembled into the receiving grooves 42 defined in the front portion of the body 41, respectively.

Figure 6:
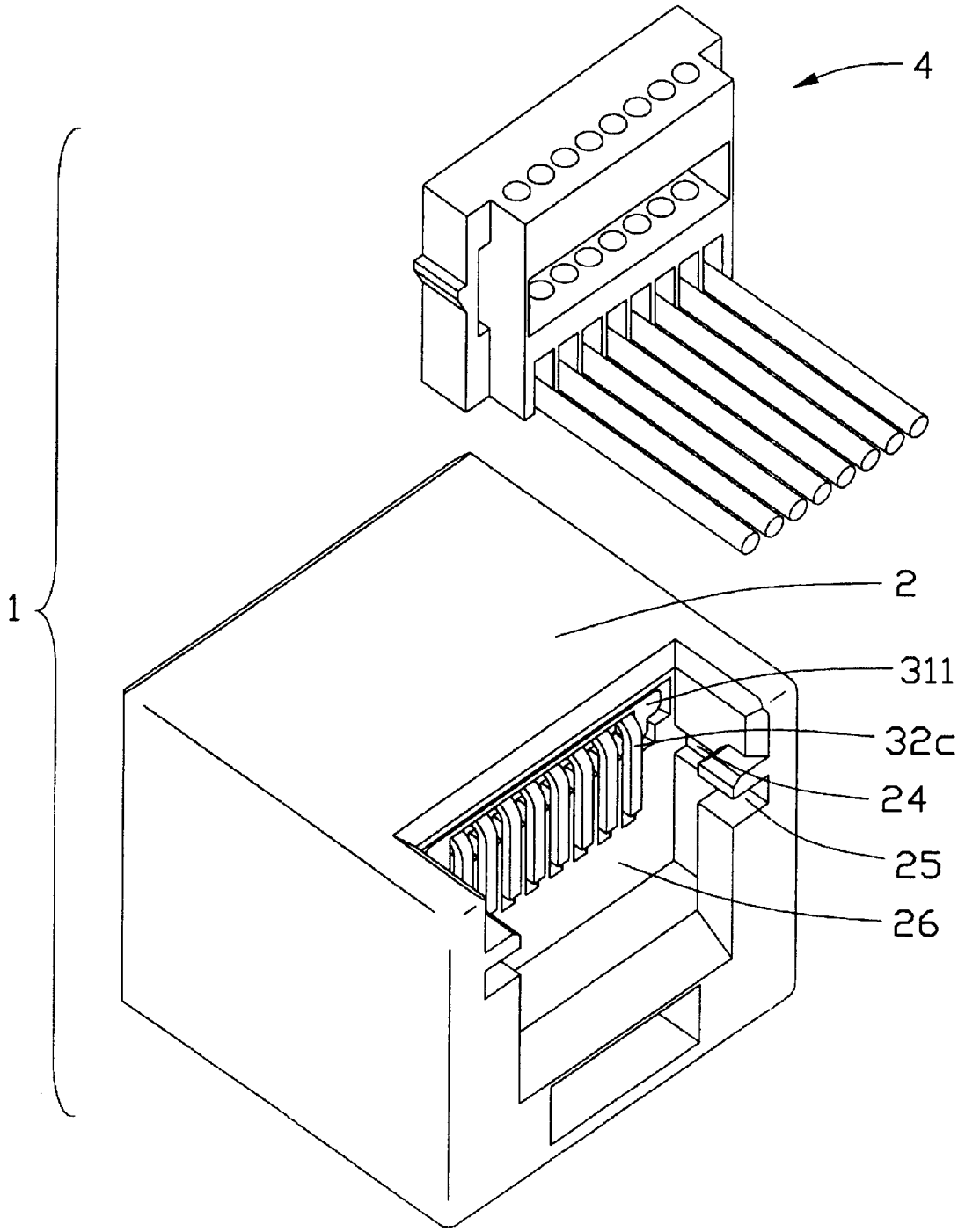
FIG. 6 is a partly assembled view of FIG. 5, with a wire spacer not assembled.
Figure 7:
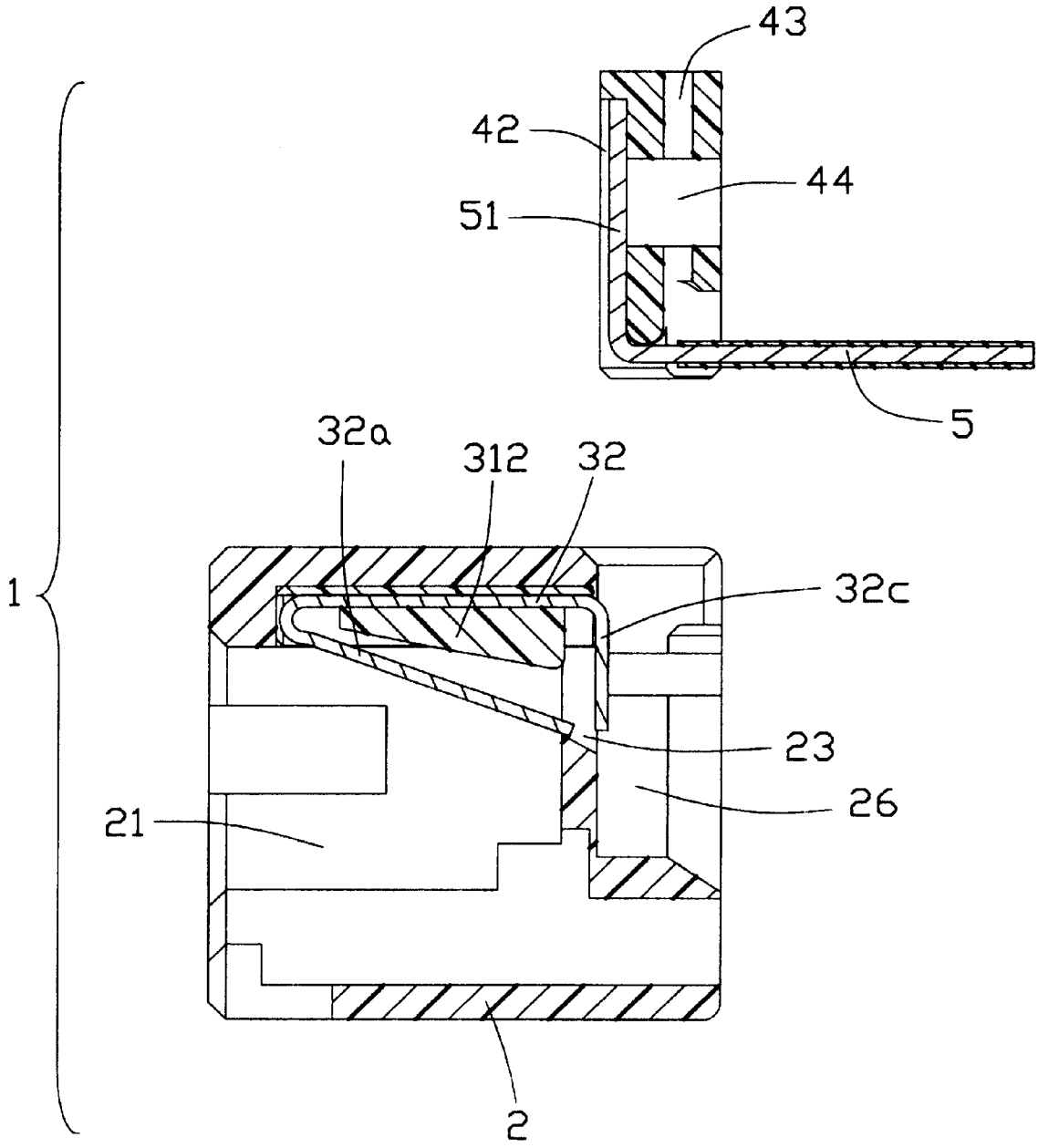
FIG. 7 is a cross sectional view of FIG. 6.

Referring to FIGS. 6 and 7, the terminal module 3 is then inserted into the housing 2 from the rear thereof. The contact portions 32*a* of the terminals 32 of the terminal module 3 are received into the receiving space 21 of the housing 2. The free end of each contact portion 32*a* is engaged with a corresponding slot 23 defined in the housing 2, and the tail portions 32*c* of the terminals 32 are exposed in the receiving opening 26. The step-like opposite side portions 311 of the base 31 of the terminal module 3 engage with inner grooves (not shown) of the housing 2 for securing the terminal module 3 therein.

Figure 8:
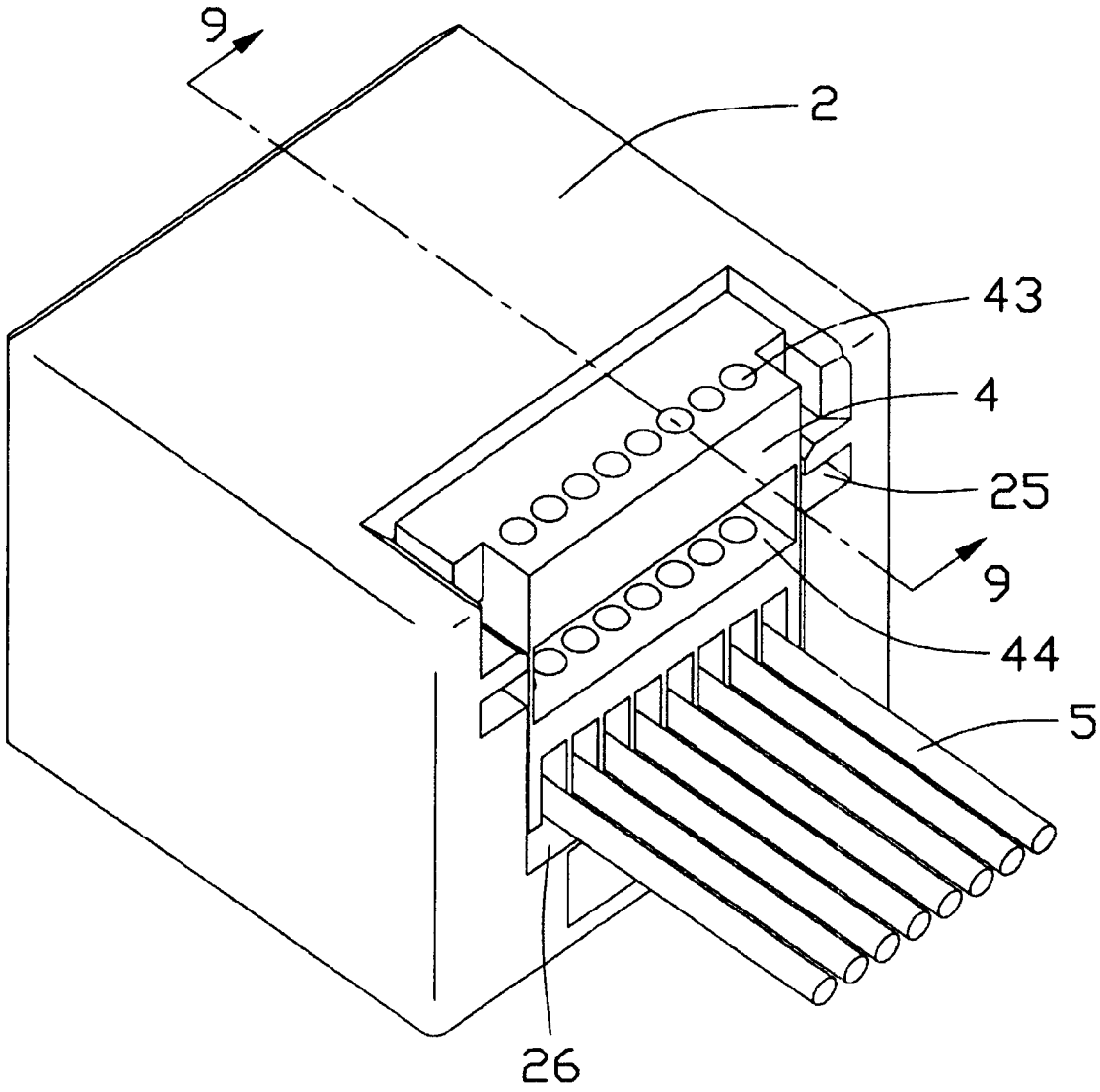
FIG. 8 is an assembled view FIG. 6.
Figure 9:
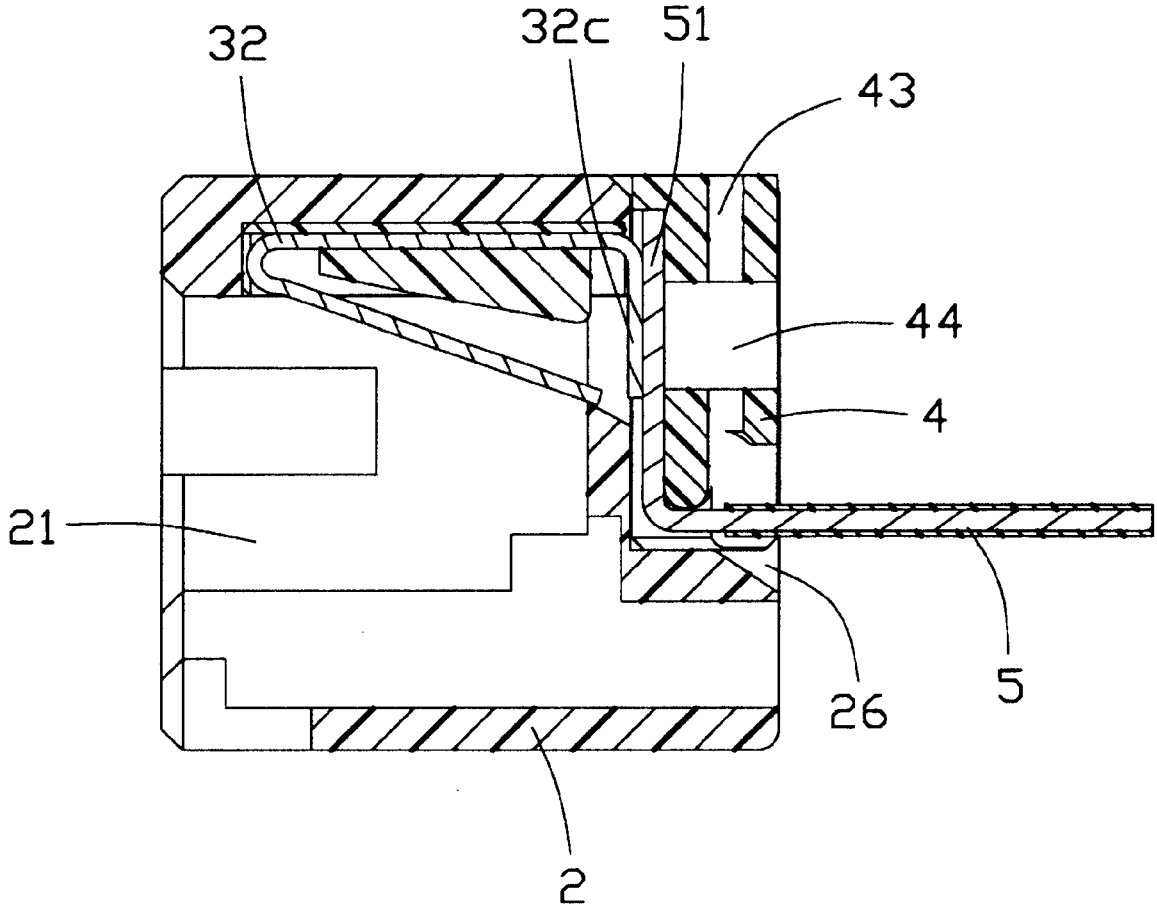
FIG. 9 is a cross sectional view of the cable connector assembly taken along line 9—9 of FIG. 8.
Figure 12:
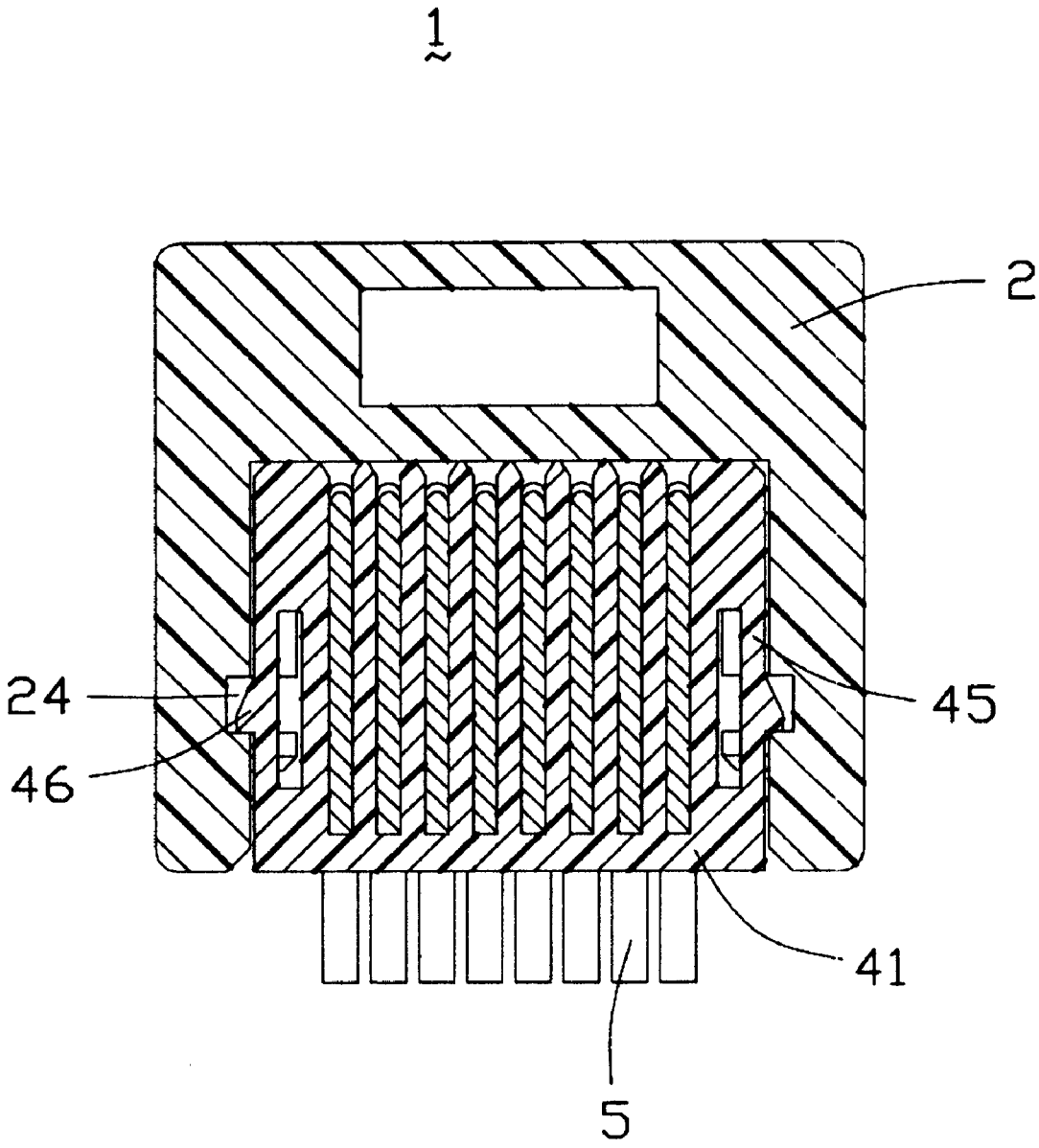
FIG. 12 is a cross sectional view of the cable connector assembly taken along line 12—12 of FIG. 10.

Now referring to FIGS. 8, 9 and 12, the wire spacer 4 is pressed into the housing 2 from the rear thereof and received in the receiving opening 26. The latches 46 of the opposite projections 45 of the body 41 are initially received in and guided along the cutouts 25 of the housing 2 and finally engage in the recesses 24 of the housing 2. Referring to FIG. 9, it can be seen that the conductor 51 of each wire 5 is received in the receiving opening 26 of the housing 2 between the body 41 of the wire spacer 4 and the housing 2 itself. The conductors 51 of the wires 5 press against the tail portions 32*c* of the terminals 32. Now a termination tool (not shown) will insert through the window 44 of the body 41 to form solder connection between the conductors 51 of the wires 5 and the tail portions 32*c* of the terminals 32.

Figure 10:
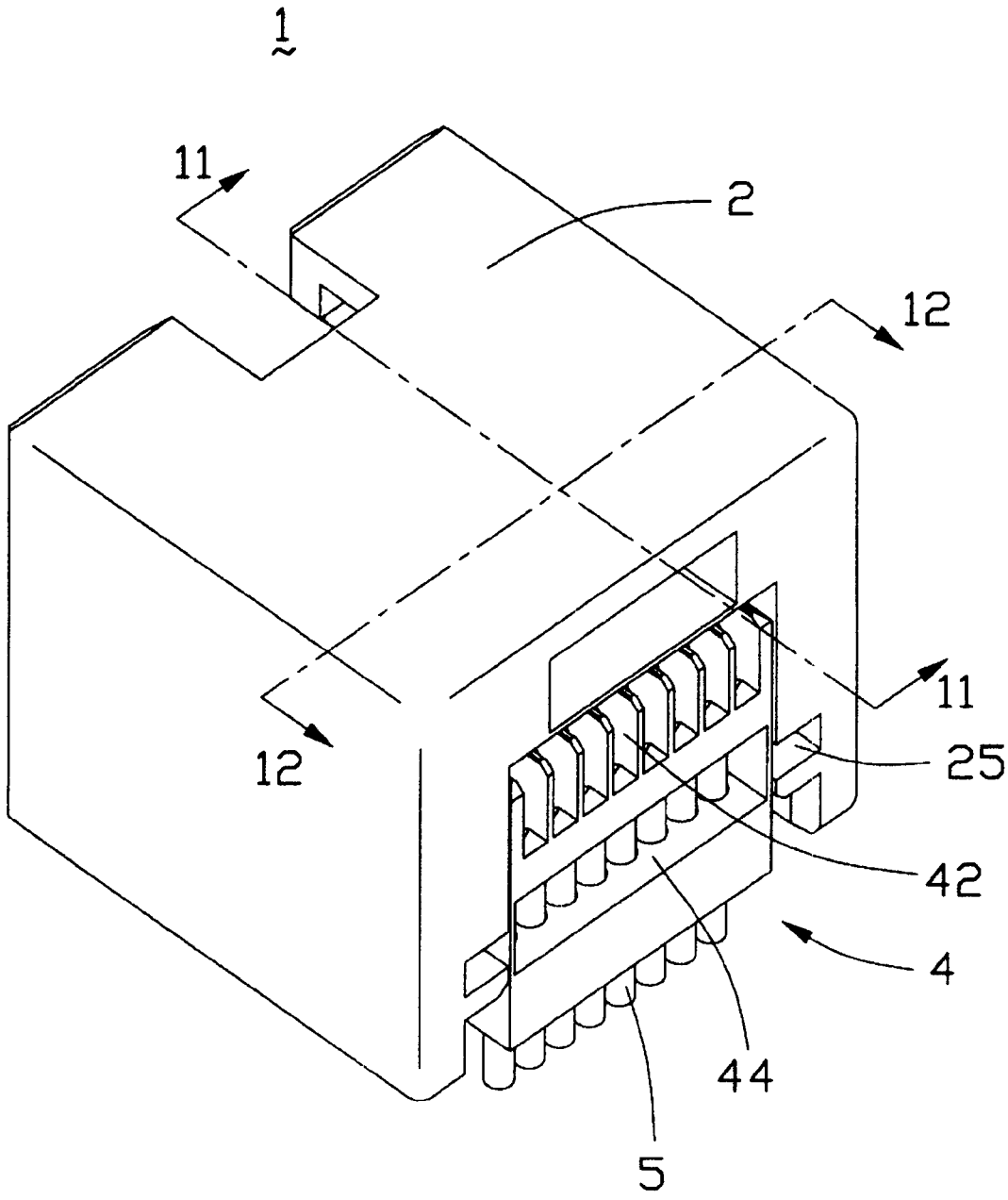
FIG. 10 is an assembled view of the cable connector assembly from a rear aspect.
Figure 11:
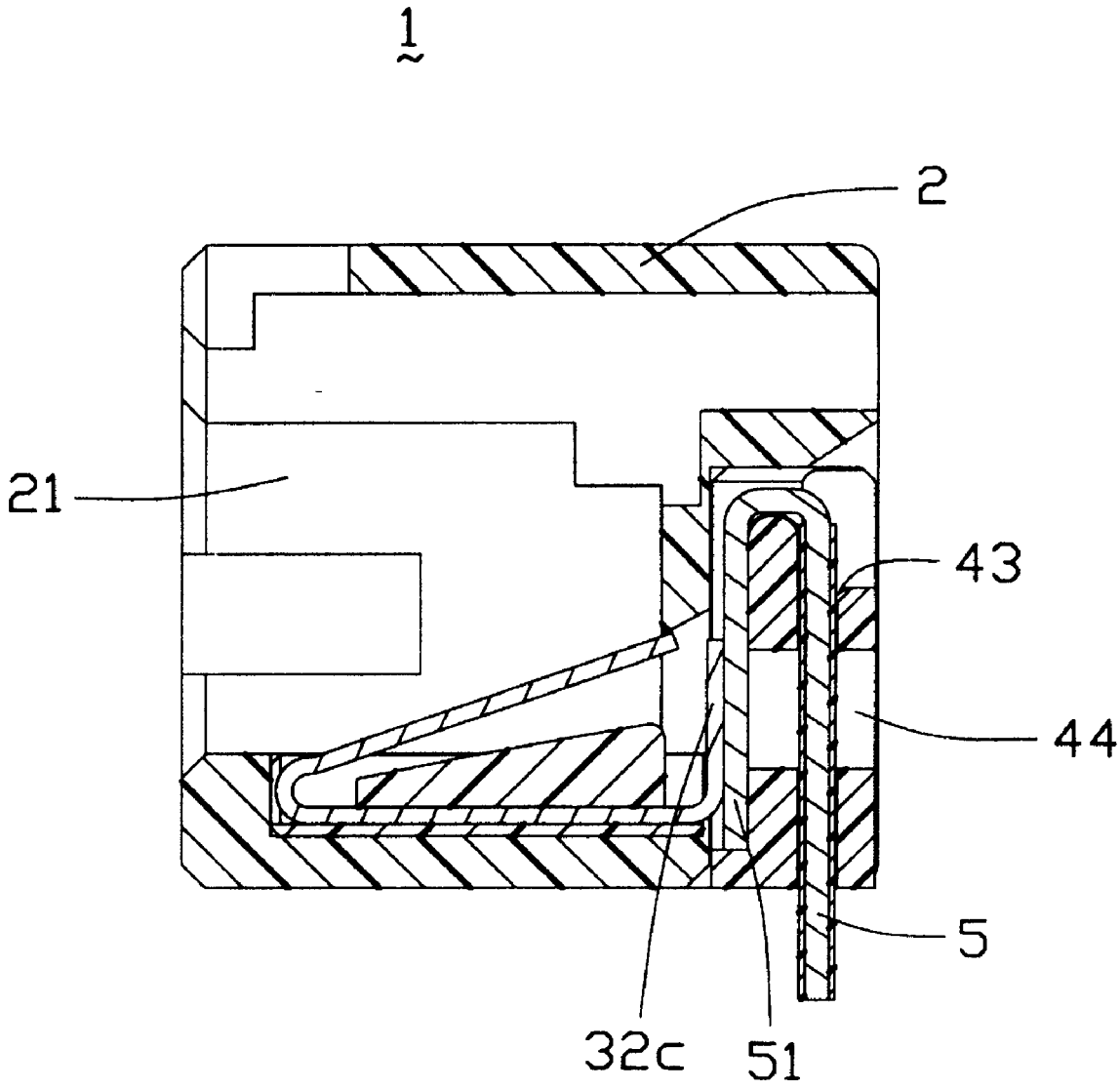
FIG. 11 is a cross sectional view of the cable connector assembly taken along line 11—11 of FIG. 10.

Referring to FIGS. 10 and 11, the portions of the wires 5 extending out of the wire spacer 4 are inserted into the through holes 43 of the wire spacer 4 from upper ends thereof, such that the wires 5 protrude beyond lower ends of the through holes 43 for strain relief.

When a relatively large force acts on the contact portions 32*a* of the terminals 32, the stoppers 312 integrally formed on the base 31 will prevent the contact portions 32*a* from being pressed too much, thereby preventing the terminals 32 from yielding. Furthermore, the tail portions 32*c* of the terminals 32 are soldered with the conductors 51 of the wires 5 by the tool inserting into the window 44 of the wire spacer 4. Even if the wires 5 are pulled or dragged, the tail portions 32*c* will not separate from the conductors 51, thereby assuring the reliability of signals transmitted therebetween. In addition, the tail portions 32*c* contact the conductors 51 through side surfaces, and the conductors 51 bend horizontally and then downwardly. This decreases the height of the cable connector assembly 1.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly, comprising:

an electrical connector comprising a dielectric housing defining a front receiving space and a rear receiving opening, a plurality of terminals received in the dielectric housing, and a wire spacer inserted into the receiving opening of the housing, each terminal including a contact portion extending into the receiving space, a retaining portion and a tail portion, the wire spacer including a body defining a plurality of vertical grooves in a front surface thereof; and a cable having a plurality of wires, each wire having a conductor received in a corresponding groove of the wire spacer and contacting the tail portion of a corresponding terminal;

wherein the body of the wire spacer defines a window in a rear surface thereof in a position corresponding to the tail portions of the terminals received in the housing, the window communicates with the grooves, and the tail portions of the terminals are soldered with the conductors of the wires by a termination tool inserting into the window; wherein the contact portions of the terminals extend upwardly and rearwardly from front ends of the retaining portions at an acute angle, and the tail portions of the terminals extend vertically and upwardly from rear ends of the retaining portions; wherein the retaining portions of the terminals are insert molded in a base, the base including a pair of step-like opposite side portions engaging with inner grooves of the housing, and a plurality of stoppers corresponding to the terminals and extending upwardly and rearwardly from a middle portion of the base for preventing the terminals from yielding; wherein the body of the wire spacer further defines a plurality of vertical through holes intersecting the window and communicating with the grooves, and the wires outwardly extend through the vertical through holes; wherein the wire spacer comprises a pair of projections formed on respective opposite ends of the body; wherein each projection has a latch, and the dielectric housing defines a pair of recesses in opposite inner side walls thereof for receiving corresponding latches; wherein the dielectric housing defines a plurality of slots in the rear thereof communicating with the receiving space, and the free end of the contact portion of each terminal is engaged in a corresponding slot.

* * * * *